US007204433B2

(12) United States Patent
Kobayashi et al.

(10) Patent No.: US 7,204,433 B2
(45) Date of Patent: Apr. 17, 2007

(54) METHOD OF MANUFACTURING A FUEL INJECTION VALVE

(75) Inventors: Takayuki Kobayashi, Gunma (JP); Hideo Kato, Tochigi (JP)

(73) Assignee: Unisia Jecs Corporation, Kanagawa (JP)

( * ) Notice: Subject to any disclaimer, the term of this patent is extended or adjusted under 35 U.S.C. 154(b) by 0 days.

(21) Appl. No.: 10/960,937

(22) Filed: Oct. 12, 2004

(65) Prior Publication Data

US 2005/0045749 A1 Mar. 3, 2005

Related U.S. Application Data

(62) Division of application No. 10/194,274, filed on Jul. 15, 2002, now Pat. No. 6,811,104.

(30) Foreign Application Priority Data

Dec. 27, 2001 (JP) ..... 2001-395543

(51) Int. Cl.
*F02M 59/00* (2006.01)
*F02M 61/00* (2006.01)
*F02M 47/02* (2006.01)
*B05B 1/30* (2006.01)

(52) U.S. Cl. ..... 239/533.2; 239/585.1; 239/585.3; 239/585.5; 239/88; 239/90; 239/91; 239/92; 239/93

(58) Field of Classification Search ..... 239/533.2, 239/533.3, 585.1, 585.3, 585.5, 88–93; 251/129.15, 251/129.21, 127; 29/890.124, 890.127
See application file for complete search history.

(56) References Cited

U.S. PATENT DOCUMENTS 3,567,135 A * 3/1971 Gebert ..... 239/463
3,865,312 A * 2/1975 Lombard et al. ..... 239/585.1
4,946,107 A * 8/1990 Hunt ..... 239/585.4
5,649,354 A * 7/1997 Fujii et al. ..... 29/607

FOREIGN PATENT DOCUMENTS

JP 2000-8990 A 1/2000

* cited by examiner

*Primary Examiner*—Davis Hwu

(74) *Attorney, Agent, or Firm*—Sughrue Mion, PLLC

(57) ABSTRACT

A fuel injection valve has: a tubular body, a valve seat member, a valve body, a core tube, a bias spring, and an electromagnetic actuator. The core tube is press fitted into the tubular body. The core tube has a first end side opposing an absorption section of the valve body in such a manner as to form an axial gap interposed between the first end side of the core tube and the absorption section. The core tube has a second end side axially extending in the tubular body to a certain position on a way to the second end side of the tubular body. The axially extending second end side of the core tube has an outer periphery which is formed with a reduced diameter section for increasing an accuracy in positioning the core tube when the core tube is press fitted into the tubular body.

10 Claims, 8 Drawing Sheets

METHOD OF MANUFACTURING A FUEL INJECTION VALVE

This is a divisional of application Ser. No. 10/194,274 filed Jul. 15, 2002 now U.S. Pat. No. 6,811,104. The entire disclosure(s) of the prior application(s), application Ser. No. 10/194,274 is considered part of the disclosure of the accompanying Divisional application and is hereby incorporated by reference.

BACKGROUND OF THE INVENTION

1. Field of the Invention

The present invention relates to a fuel injection valve used for injecting fuel to an automotive engine and the like.

2. Description of the Related Art

Japanese Patent Unexamined Publication No. P2000-8990A (2000008990) describes a fuel injection valve which is used for an automotive engine and the like. Generally, a valve casing of the fuel injection valve is made of magnetic metal material and the like, and is shaped substantially into a tube. A valve body of the fuel injection valve is displaceably inserted in an inner periphery of the valve casing. In an operation period of the fuel injection valve, a magnetic field generated by an electromagnetic coil may act on the valve body by way of the valve casing, thereby opening the valve body magnetically.

BRIEF SUMMARY OF THE INVENTION

It is an object of the present invention to provide a fuel injection valve with accuracy in fuel injection amount improved by stabilizing stroke of a valve body, wherein stabilization of the stroke is effected by a general mechanical machining on a core tube.

According to the present invention, there is provided a fuel injection valve, comprising: a tubular body, a valve seat member, a valve body, a core tube, a bias spring, and an electromagnetic actuator. The tubular body is made of a magnetic material and formed substantially into a tube. The tubular body has a first end side and a second end side opposite to the first end side. The valve seat member is disposed on the first end side of the tubular body. The valve seat member is formed with a fuel injection port and a valve seat surrounding the fuel injection port. The valve body is displaceably disposed in the tubular body. The valve body has a first end side defining a valve section which is detachably seated on the valve seat of the valve seat member. The valve body has a second end side, which is opposite to the first end side thereof, defining an absorption section. The core tube is press fitted into the tubular body. The core tube has a first end side opposing the absorption section of the valve body in such a manner as to form an axial gap interposed between the first end side of the core tube and the absorption section of the valve body. The core tube has a second end side axially extending in the tubular body to a certain position on a way to the second end side of the tubular body. The axially extending second end side of the core tube has an outer periphery which is formed with a reduced diameter section for increasing an accuracy in positioning the core tube when the core tube is press fitted into the tubular body. The bias spring is disposed in the tubular body, and biases the valve body in a direction for closing the valve body. The electromagnetic actuator is disposed at the tubular body. The electromagnetic actuator forms a magnetic field between the absorption section of the valve body and the core tube so as to allow the valve body to open opposing the bias spring.

The other objects and features of the present invention will become understood from the following description with reference to the accompanying drawings.

DETAILED DESCRIPTION OF THE EMBODIMENTS

In the following, various embodiments of the present invention will be described in detail with reference to the accompanying drawings.

For ease of understanding, the following description will contain various directional terms, such as, upper, lower and the like. However, such terms are to be understood with respect to only a drawing or drawings on which the corresponding part of element is illustrated.

As is seen in FIG. 1 to FIG. 7, there is provided a fuel injection valve applied to an automotive engine, according to a first embodiment of the present invention.

There is provided a valve casing 1 constituting an outer casing of the fuel injection valve. Valve casing 1 is constituted of a tubular body 2 (to be described afterward), a magnetic cover 14, a resin cover 17, and the like.

Tubular body 2 constitutes a body section of valve casing 1. Tubular body 2 is formed of a metal pipe and the like which is made of magnetic metal material such as electromagnetic stainless steel. As is seen in FIG. 1 to FIG. 7, tubular body 2 is formed substantially into a stepped tube.

Figure 7:
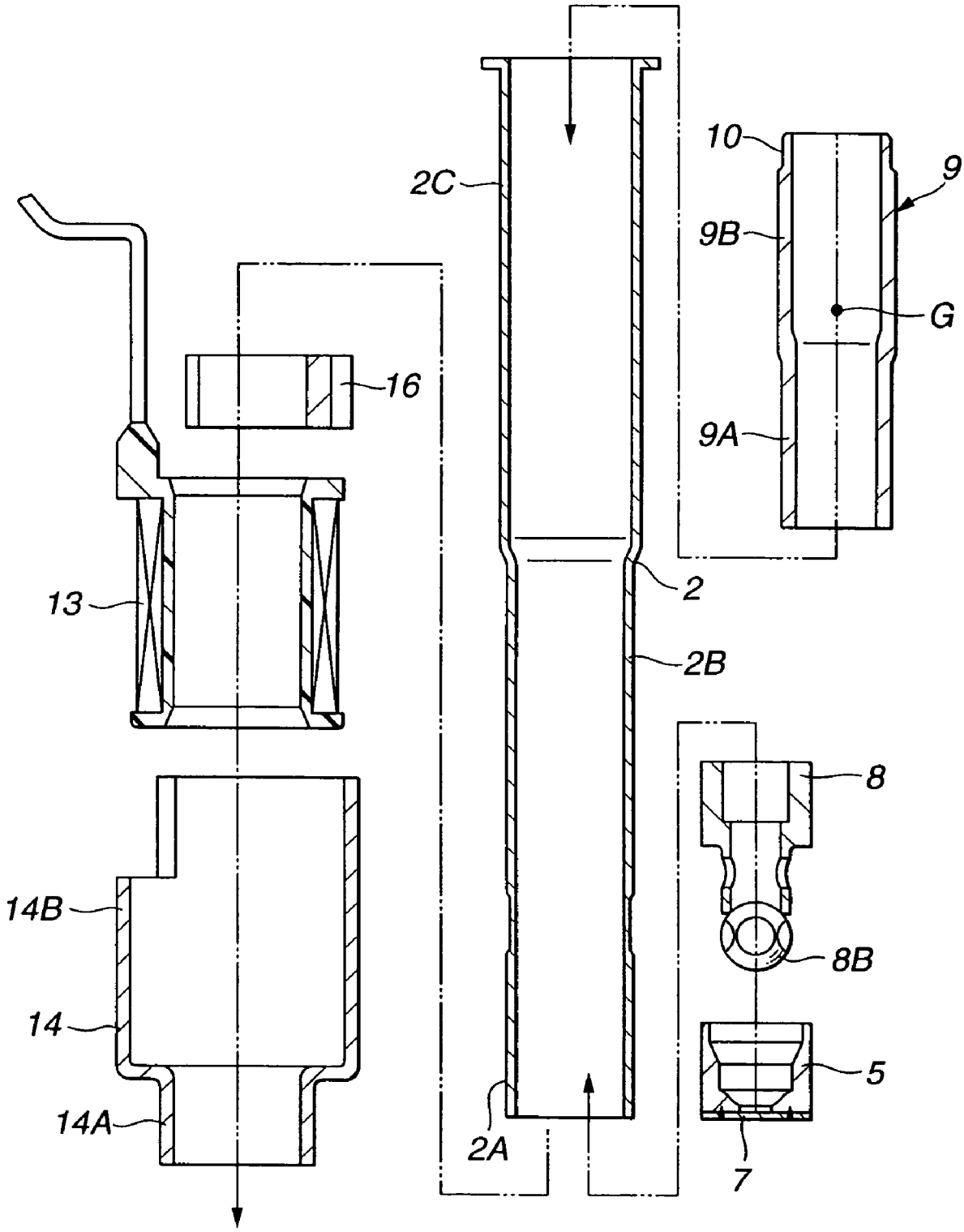
FIG. 7 is a longitudinal cross section showing a state before assembling a tubular body 2, a valve seat member 5, the valve body 8, the core tube 9, an electromagnetic coil 13, a magnetic cover 14, and a couple core 16.

Stepped tubular body 2 is constituted of a valve body receiver 2A, a core tube mating section 2B, and a fuel passage section 2C. Valve body receiver 2A is disposed on a first end side (lower in FIG. 1) of tubular body 2. A valve body or valve element 8 (to be described afterward) can be displaceably received in valve body receiver 2A. Core tube mating section 2B is unitedly disposed on a second end side (upper in FIG. 1) of tubular body 2A. A core tube 9 (to be described afterward) can be inserted in core tube mating section 2B. Fuel passage section 2C is disposed on a second end side (upper in FIG. 1) of core tube mating section 2B, and is shaped substantially into a tube having a diameter larger than that of core tube mating section 2B. Namely, stepped tubular body 2 includes a larger body section formed by fuel passage section 2C and a smaller body section formed by core tube mating section 2B. As best shown in FIG. 7, stepped tubular body 2 further includes a step portion connecting the larger body section (2C) and the smaller body section (2B). Fuel passage section 2C has an inner periphery which forms a fuel passage 3 extending axially up to valve body receiver 2A and core tube mating section 2B. Valve body receiver 2A, core tube mating section 2B, and fuel passage section 2C are arranged substantially coaxial.

Figure 1:
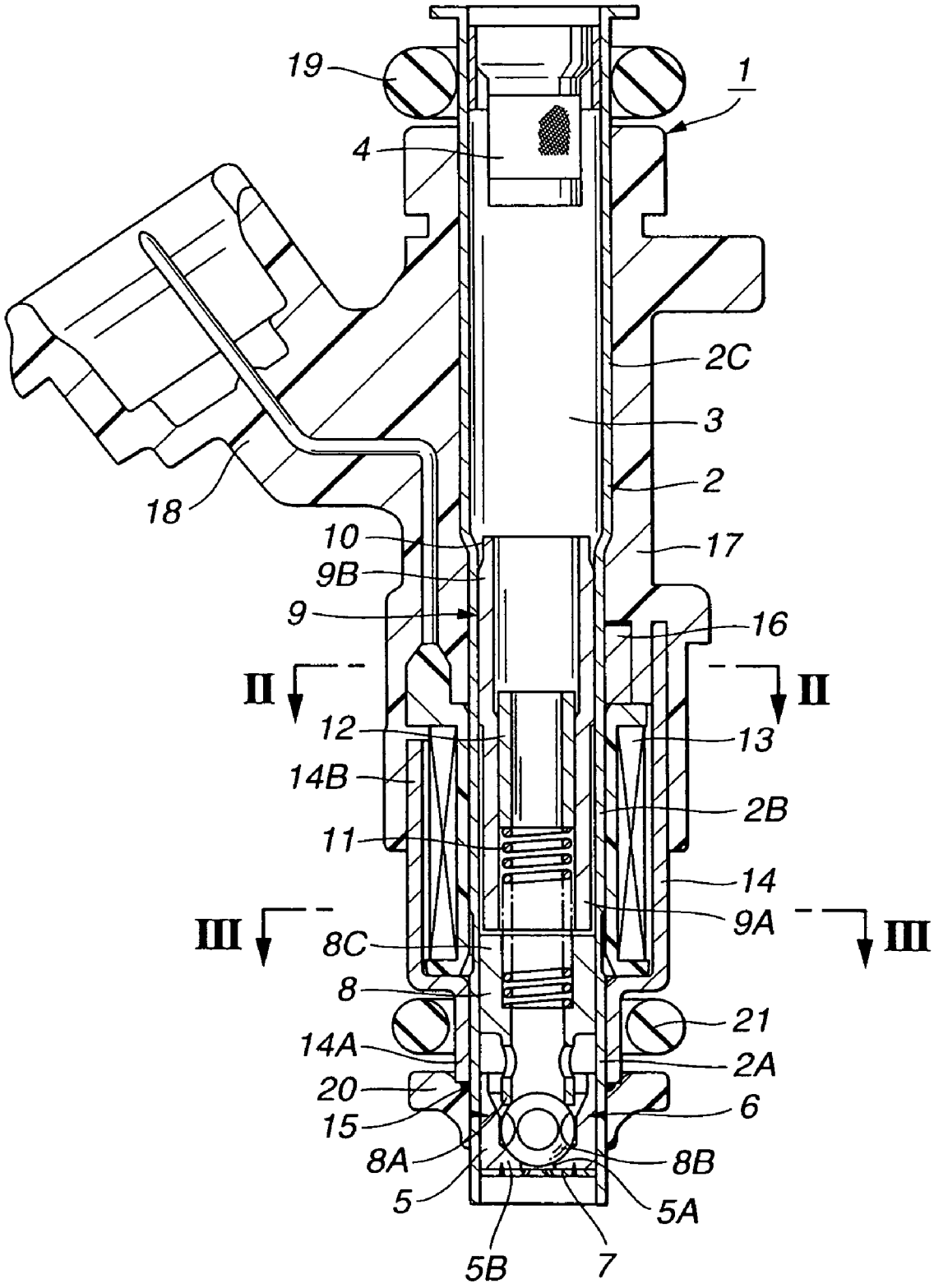
FIG. 1 is a longitudinal cross section of a fuel injection valve, according to a first embodiment of the present invention.
Figure 4:
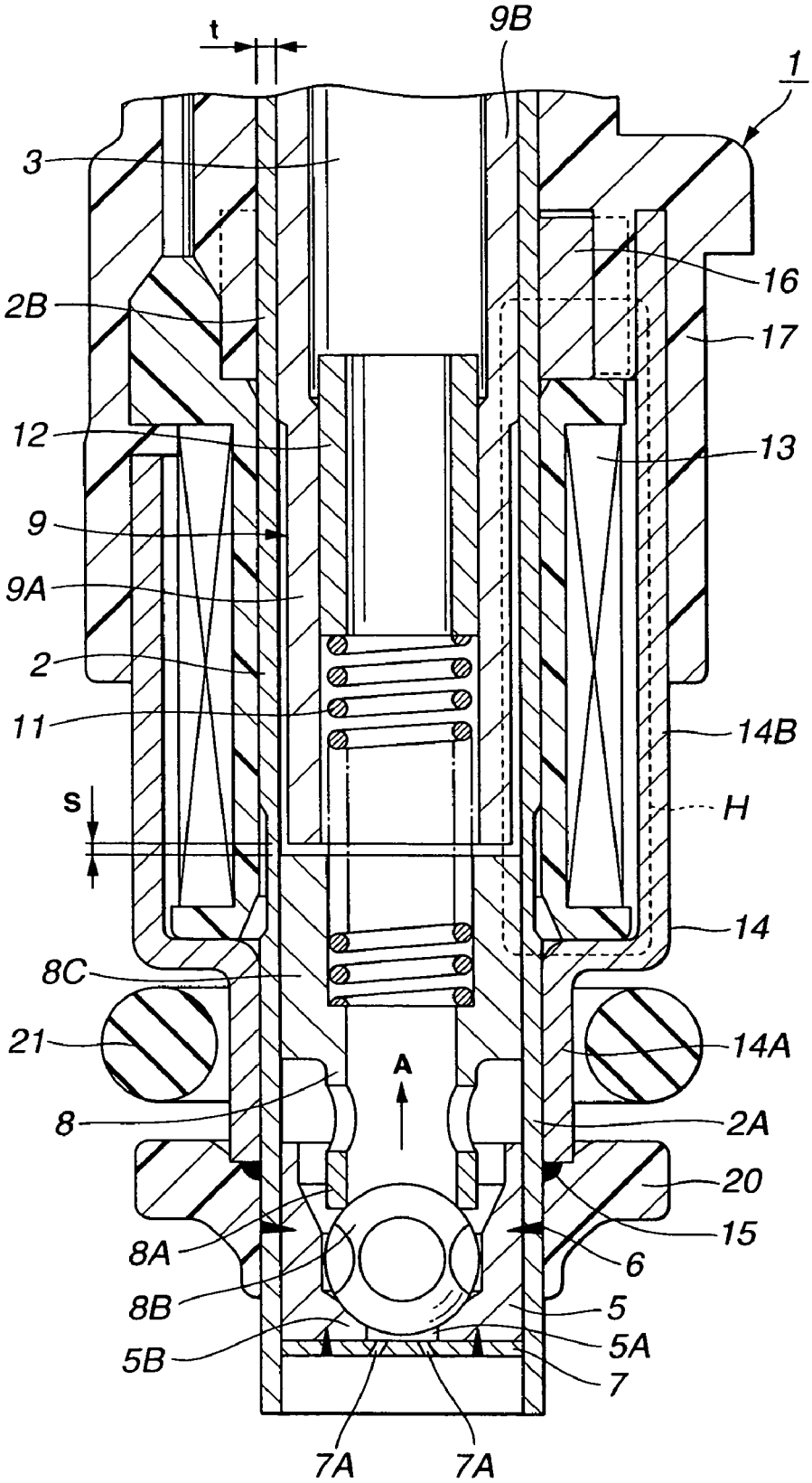
FIG. 4 is an enlarged cross section of an essential part of the fuel injection valve in FIG. 1, showing especially a valve body 8's side of the fuel injection valve.

As is seen in FIG. 4, each of valve body receiver 2A and core tube mating section 2B of tubular body 2 may have a predetermined radial thickness t in a range from 0.2 mm to 10.0 mm, more preferably, 0.2 mm to 3.0 mm. Moreover, valve body receiver 2A and core tube mating section 2B are tubular bodies having substantially the same diameter each other. In this example, the smaller body section of stepped tubular body 2 is formed by valve body receiver 2A and core tube mating section 2B. Moreover, as is seen in FIG. 1, there is provided a fuel filter 4 in fuel passage section 2C of tubular body 2. Fuel filter 4 can filter fuel which is fed to fuel passage 3 from outside.

There is provided a valve seat member or valve seat 5 which is substantially tubular, and is inserted in an inner periphery on a first end side (lower in FIG. 4) of valve body receiver 2A. As is seen in FIG. 4, valve seat member 5 has a fuel injection port 5A and an annular valve seat 5B. Fuel in fuel passage 3 can be injected outward through fuel injection port 5A. Valve seat 5B is formed substantially conical, and surrounds fuel injection port 5A. Moreover, a valve section 8B of a valve body 8 (to be described afterward) makes a movement such that valve section 8B can be seated on valve seat 5B and spaced apart from valve seat 5B.

Moreover, valve seat member 5 can be inserted in the inner periphery on the first end side (lower in FIG. 4) of valve body receiver 2A of tubular body 2. Entire part of an outer periphery of valve seat member 5 is welded to the inner periphery of valve body receiver 2A via a weldment 6. Moreover, there is provided a nozzle plate 7 on a periphery on a first end side (lower in FIG. 4) of valve seat member 5. Nozzle plate 7 is fixed in such a position as to cover fuel injection port 5A. Nozzle plate 7 is formed with a plurality of nozzle holes 7A.

There is provided a valve body 8 which is displaceably received in valve body receiver 2A of tubular body 2. Valve body 8 is constituted of a valve shaft 8C, a valve section 8B, and an absorption section 8C. Valve shaft 8A is tubular, and extends axially in valve body receiver 2A. Valve section 8B is substantially spherical and is fixed to a first end side (lower in FIG. 4) of valve shaft 8A. Moreover, valve section 8B can be seated on valve seat 5B valve seat member 5 and spaced apart from valve seat 5B. Absorption section 8C is made of magnetic metal material and the like, and is integrated with a second end side (upper in FIG. 4) of valve shaft 8A. Moreover, absorption section 8C is substantially tubular, and can be slidably inserted in valve body receiver 2A.

In a period when valve body 8 is closed, valve section 8B can be kept seated on valve seat 5B of valve seat member 5 with a bias force applied by a bias spring 11 (to be described afterward). In this period, periphery on a second end side (upper in FIG. 4) of absorption section 8C and core tube 9 oppose each other, defining therebetween an axial gap S having a predetermined dimension, as is seen in FIG. 4.

On the other hand, energizing an electromagnetic coil 13 (to be described afterward) can generate a magnetic field H as depicted by dashed lines in FIG. 4, to thereby allow absorption section 8C of valve body 8 to be magnetically absorbed to core tube 9. With this, valve body 8 can be axially displaced by a distance equivalent to axial gap S against the bias force by bias spring 11. Thus, valve body 8 can be opened in a direction A as is seen in FIG. 4.

There is provided core tube 9 as a core member which is made of magnetic metal material and the like and is shaped substantially into a tube. Machining operations such as cutting, polishing and the like carried out on the inner periphery and the outer periphery of core tube 9 can form a stepped tubular body, as is seen in FIG. 7. A first axial side (lower in FIG. 7) of core tube 9 is a small (diameter) tube section 9A, while a second axial side (upper in FIG. 7) of core tube 9 is a large (diameter) tube section 9B. Moreover, core tube 9 has a gravity center G which is disposed on large diameter section 9B for ease of centerless polishing and the like (to be described afterward)

Core tube 9 can be inserted in core tube mating section 2B of tubular body 2 with a press fitting means. As is seen in FIG. 4, core tube 9 can be fixed in core tube mating section 2B in such a position that a first end face (lower in FIG. 4) of small diameter section 9A opposes the second end face (upper in FIG. 4) of absorption section 8C, defining therebetween axial gap S. In this case, press fitting core tube 9 into core tube mating section 2B of tubular body 2 causes the outer periphery of large diameter section 9B of core tube 9 to abrasively abut on the inner periphery of core tube mating section 2B.

Large diameter section 9B of core tube 9 extends axially up to a certain position on a way to the second end of tubular body 2. More specifically, as is seen in FIG. 1. and FIG. 5, the second end (upper) of large diameter section 9B protrude axially from core tube mating section 2B toward inside fuel passage section 2C. In addition, the second end of large diameter section 9B has an outer periphery which is formed with a depth cut 10 (to be described afterward).

Figure 5:
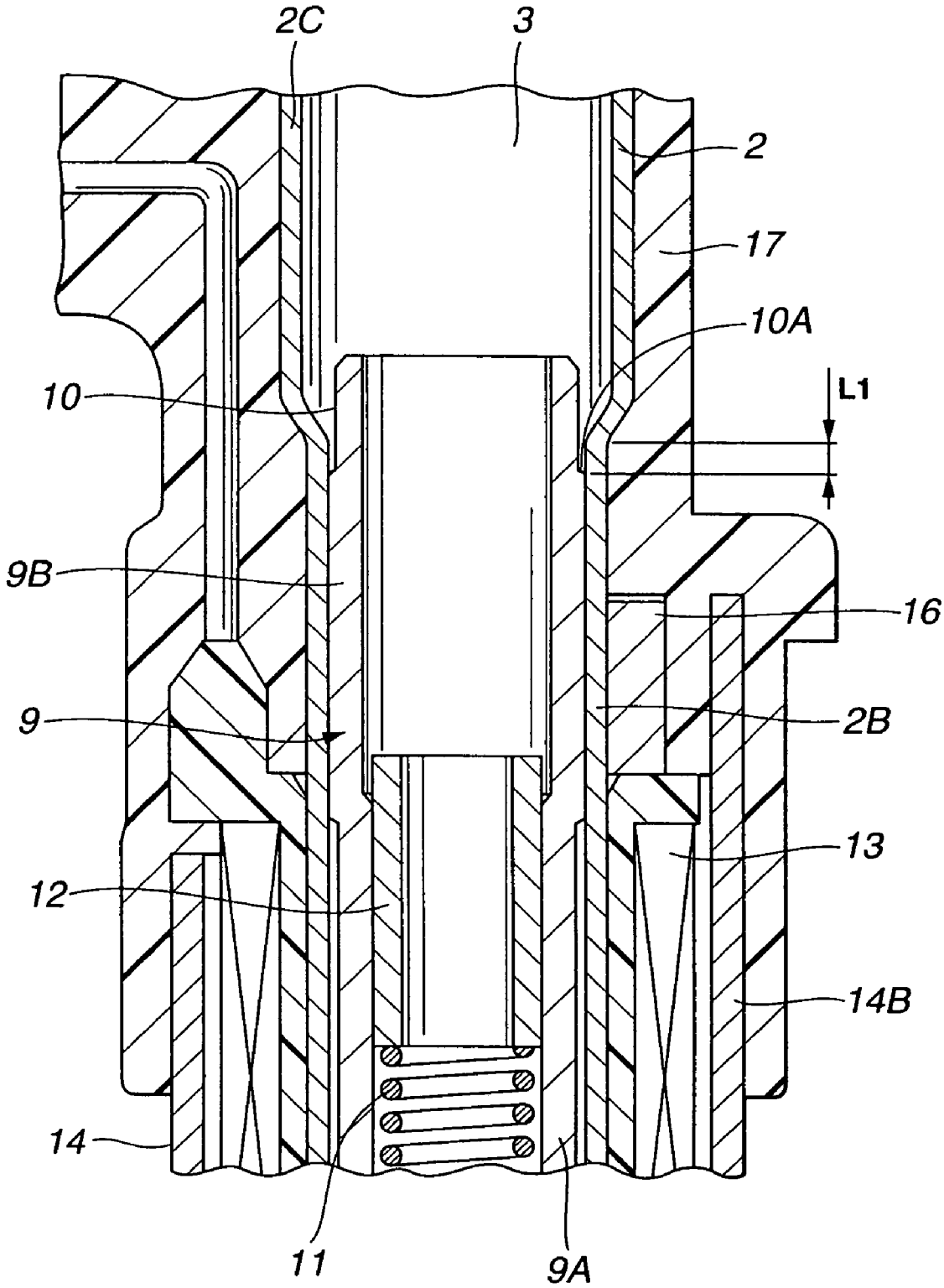
FIG. 5 is an enlarged cross section of the essential part of the fuel injection valve in FIG. 1, showing especially a core tube 9's side of the fuel injection valve.

There is provided depth cut 10 which is a reduced (diameter) section defined on the outer periphery on the second end side of large diameter section 9B of core tube 9. Depth cut 10 can be formed through operations such as cutting, polishing and the like. More specifically, as is seen in FIG. 1 and FIG. 5, depth cut 10 has a depth for example 100 μm around entire circumference of the second end of large diameter section 9B. Depth cut 10 can increase frictional resistance (to be described afterward) of core tube 9 against core tube mating section 2B, which frictional resistance may be caused when core tube 9 is press fitted into tubular body 2. With the increase in the frictional resistance, accuracy in positioning core tube 9 press fitted into tubular body 2 can be increased.

Therefore, depth cut 10 extends axially from an end face of large diameter section 9B of core tube 9 by a predetermined distance. Depth cut 10 defines a depth cut end 10A which is disposed in such a position that large diameter section 9B of core tube 9 can define a length L1 (L1>0) relative to the second end (upper in FIG. 5) of core tube mating section 2B into which large diameter section 9B of core tube 9 is press fitted.

There is provided bias spring 11 disposed in tubular body 2. There is provided a spring bearing 12 which is substantially tubular, and is fixed inside core tube 9 through press fitting and the like. Moreover, bias spring 11 can be compressedly disposed between spring bearing 12 and valve body 8 inside core tube 9, to thereby bias constantly valve body 8 in a direction of closing valve body 8.

There is provided electromagnetic coil 13 fitting over the outer periphery of core tube mating section 2B of tubular body 2. Electromagnetic coil 13 can act as an actuator. Energizing electromagnetic coil 13 by means of a connector 18 (to be described afterward) can generate magnetic field H which is depicted by the dashed lines, as is seen in FIG. 4. In addition, magnetic field H can allow absorption section 8C of valve body 8 to be absorbed on the first end face (lower in FIG. 4) of small diameter section 9A of core tube 9, to thereby open valve 8 opposing the bias force by bias spring 11.

There is provided magnetic cover 14 which is made of magnetic metal material and the like, and is shaped substantially into a stepped tube. As is seen in FIG. 4, magnetic cover 14 is constituted of a small diameter tube 14A and a large diameter tube 14B. Small diameter tube 14A is welded to the outer periphery of valve body receiver 2A of tubular body 2 via an annular weldment 15. Large diameter tube 14B is larger in diameter than small diameter tube 14A, and is united with a second end (upper in FIG. 4) of small diameter tube 14A. Moreover, large diameter tube 14B can cover electromagnetic coil 13 radially outside.

Figure 2:
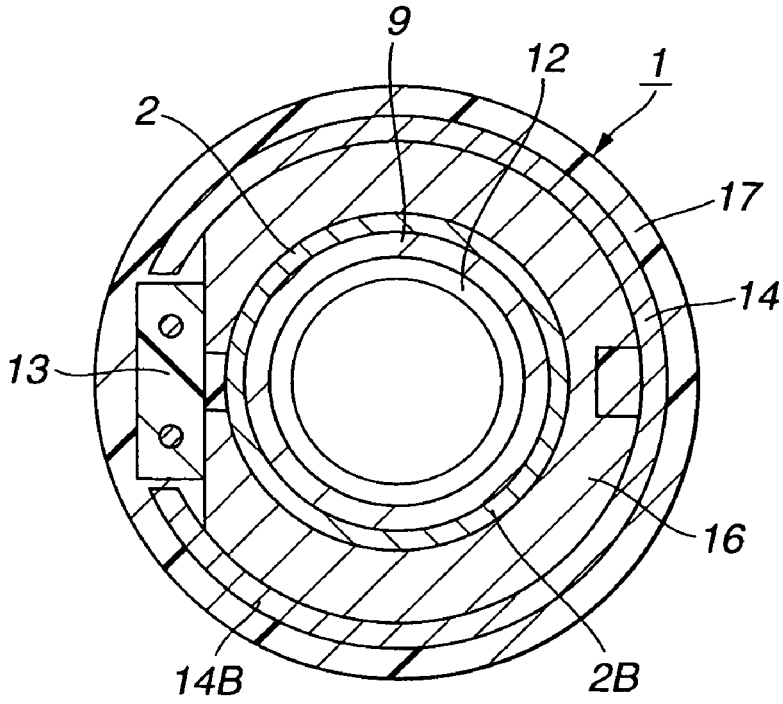
FIG. 2 is an enlarged cross section of the fuel injection valve, taken along lines II—II in FIG. 1.
Figure 3:
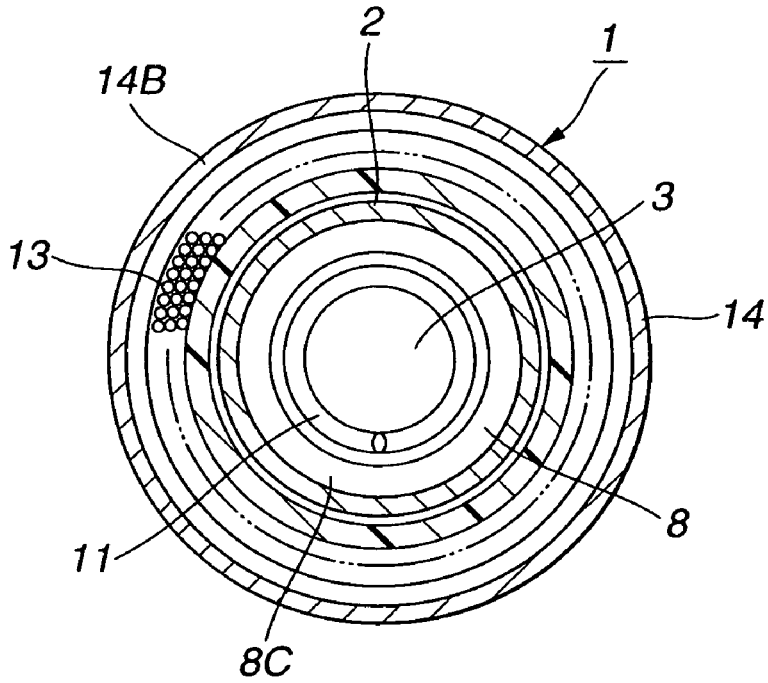
FIG. 3 is an enlarged cross section of the fuel injection valve, taken along lines III—III in FIG. 1.

As is seen in FIG. 2, there is provided a couple core 16 fitting over the outer periphery of core tube mating section 2B of tubular body 2. Couple core 16 is made of magnetic metal material and the like, and is shaped substantially into an alphabetical C. Couple core 16 can magnetically couple large diameter tube 14B of magnetic cover 14 with core tube mating section 2B of tubular body 2. In cooperation with magnetic cover 14, couple core 16 can form a magnetic path on the outer periphery of electromagnetic coil 13.

Magnetizing electromagnetic coil 13 can generate magnetic field H, as depicted by the dashed lines in FIG. 4, along a closed magnetic path which is constituted of valve body receiver 2A (of tubular body 2), core tube mating section 2B (of tubular body 2), absorption section 8C (of valve body 8), core tube 9, magnetic cover 14, and couple core 16. With magnetic field H thus generated, absorption section 8C of valve body 8 can be absorbed to the first end (lower in FIG. 4) of small diameter section 9A of core tube 9.

On the other hand, there is provided resin cover 17 which is so disposed, through resin molding and the like, as to cover tubular body 2 and the second end (upper in FIG. 4) of magnetic cover 14. As is seen in FIG. 1, resin cover 17 is fitted with connector 18 for energizing electromagnetic coil 13. Moreover, there is provided an O-ring 19 on the outer periphery on the second end side (upper in FIG. 1) of tubular body 2 protruding from resin cover 17. O-ring 19 can act as a seal member for sealing a space defined between the fuel injection valve and a fuel piping (not shown) or the like.

As is seen in FIG. 1 and FIG. 4, there is provided an annular protector 20 disposed at valve body receiver 2A of tubular body 2. Annular protector 20 is made of resin material and the like, and protrudes radially outward from valve body receiver 2A.

Moreover, there is provided an O-ring 21 fitting over the first end (lower in FIG. 1) of tubular body 2. O-ring 21 is disposed between magnetic cover 14 and annular protector 20 in a retained state. O-ring 21 can be used for example in the following case:

When the first end of tubular body 2 mates with a boss section (not shown) and the like disposed at an intake pipe of an engine, O-ring 21 can seal an area defined between the first end of tubular body 2 and the boss section.

Described hereinafter is operation of the fuel injection valve, according to the first embodiment of the present invention.

Before assembling the fuel injection valve, the inner periphery and the outer periphery of core tube 9 are subjected to machining operations such as cutting, polishing and the like. For example, as is seen in FIG. 7, small diameter section 9A and large diameter section 9B are formed at core tube 9, while entire circumference of the outer periphery on the second end side of large diameter section 9B is formed with depth cut 10 as reduced diameter section.

Then, thus formed core tube 9 is press fitted into core tube mating section 2B of tubular body 2, while electromagnetic coil 13 and magnetic cover 14 are allowed to fit over tubular body 2. Then, resin cover 17 is allowed to fit over electromagnetic coil 13 and magnetic cover 14 by means of resin molding and the like. Moreover, valve body 8, bias spring 11 and the like are mounted in valve body receiver 2A of tubular body 2. Thereafter, valve seat member 5 is inserted in body receiver 2A of tubular body 2, and then welded. With the steps described above, the fuel injection valve can be assembled.

When the fuel injection valve is mounted on the automotive engine and the like, the fuel can be supplied in fuel passage 3 of tubular body 2, from the fuel piping and the like which is connected to the second end (upper in FIG. 1) of tubular body 2 by way of O-ring 19 and the like. Allowing connector 18 to energize electromagnetic coil 13 can generate magnetic field H, as is seen in FIG. 4. Thus generated magnetic field H can pass between absorption section 8C (of valve body 8) and core tube 9.

Thus, valve body 8 can be magnetically absorbed by core tube 9, and therefore is displaced axially opposing the bias force by bias spring 11. As a result, valve section 8B of valve body 8 can be spaced apart from valve seat 5B of valve seat member 5, to thereby open valve body 8. With this, the fuel in fuel passage 3 can be injected from fuel injection port 5A toward the intake pipe and the like of the engine.

The fuel injection valve to be assembled in the manner described above may have the following constitution:

Axial gap S between valve body 8 and core tube 9 is secured larger than its predetermined set value, in view of welding error and the like which may be caused when valve seat member 5 is welded in valve body receiver 2A of tubular body 2.

After the fuel injection valve is assembled, axial gap S is subjected to adjustment to its predetermined set value by axially press fitting again core tube 9 into core tube mating section 2B of tubular body 2.

In the above adjustment of axial gap S, core tube 9, as the case may be, makes a return movement with an error for example about several tens of μm in core tube mating section 2B of tubular body 2. The above error (return movement) is attributable to residual stress and the like which may be caused when core tube 9 is press fitted axially with the press fitting means. The above error (return movement) may increase axial gap S between absorption section 8C (of valve body 8) and core tube 9. Even if such increase in axial gap S is minor, stroke of valve body 8 will vary, thereby deteriorating accuracy in controlling fuel injection amount.

According to the first embodiment, accuracy in positioning the core tube 9 in tubular body 2 can be improved by allowing depth cut 10 to increase frictional resistance which may be caused when core tube 9 is press fitted into core tube mating section 2B of tubular body 2. Hereinabove, depth cut 10 is the one that is formed around the entire circumference of the outer periphery on the second end side (upper in FIG. 1 and FIG. 5) of large diameter section 9B of core tube 9.

Figure 6:
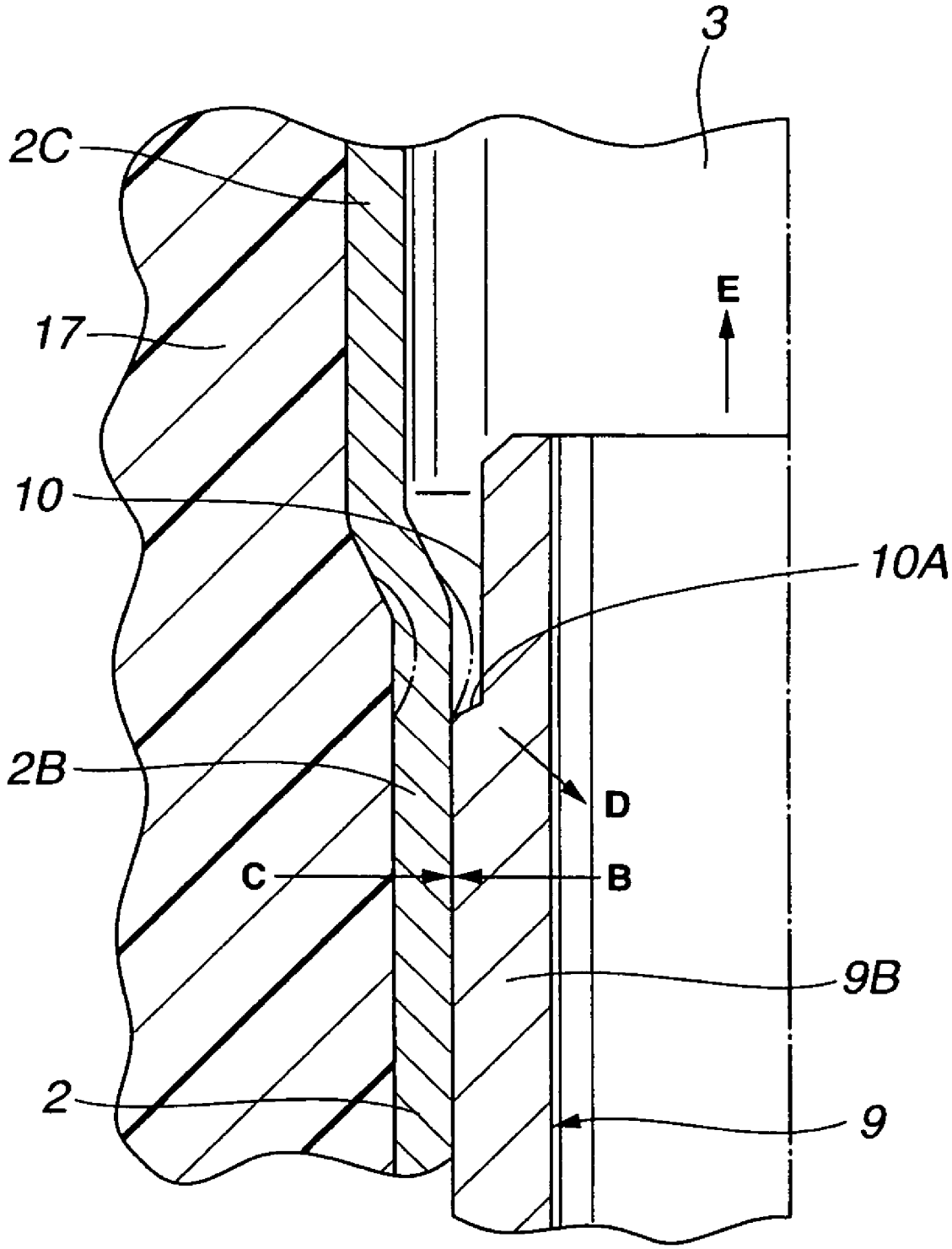
FIG. 6 is an enlarged cross section of a part in the vicinity of a depth cut 10 in FIG. 5.

More specifically described as follows: High-accuracy polishing is carried out on the outer periphery of large diameter section 9B, so that press fitting large diameter section 9B (of core tube 9) into core tube mating section 2B (of tubular body 2) can cause frictional abutment between the outer periphery of large diameter section 9B and the inner periphery of core tube mating section 2B. Press fitting large diameter section 9B (of core tube 9) into core tube mating section 2B (of tubular body 2) may cause a force in a direction B toward tubular body 2, as is seen in FIG. 6, in other words, the force in direction B is for increasing diameter. On the other hand, press fitting large diameter section 9B may cause a force in a direction C toward large diameter section 9B, in other words, the force in direction C is for decreasing diameter.

The thus caused force in direction B for increasing diameter and the force in direction C for decreasing diameter can be in balance with each other on the outer periphery of large diameter section 9B of core tube 9. In core tube mating section 2B's position corresponding to depth cut 10, however, only the force in direction C may be caused, in other words, the force for decreasing diameter. Thereby, in the vicinity of depth cut end 10A of depth cut 10, core tube mating section 2B of tubular body 2 may partly cause an elastic deformation depicted with imaginary lines, as is seen in FIG. 6, thereby causing a wedge force in a direction D.

As a result, at depth cut end 10A of depth cut 10, the above wedge force in direction D can cause an anchor effect (wedge action) on large diameter section 9B of core tube 9, to thereby increase the frictional resistance between tubular body 2 and core tube 9. In addition, the wedge force in direction D may cause the elastic deformation of core tube mating section 2B such that part of core tube mating section 2B can slightly engage with depth cut end 10A of depth cut 10. In sum, the anchor effect can control the return movement (attributable to the residual stress and the like) of core tube 9 in direction E as is seen in FIG. 6.

In sum, accuracy in positioning core tube 9 in tubular body 2 can be thus improved, to thereby allow axial gap S between valve body 8 and core tube 9 to be adjustable to the predetermined set value. In addition, magnetic field H generated by electromagnetic coil 13 can pass between valve body 8 and core tube 9, to thereby allow valve body 8 to be opened at an adjusted stroke (equivalent to axial gap S). In sum, stable fuel injection amount can be controlled.

According to the first embodiment, forming depth cut 10 around the entire circumference on the second end side of large diameter section 9B of core tube 9 by means of general machining operations can set a constant stroke of valve body 8, thereby improving accuracy in the fuel injection amount.

Gravity center G of core tube 9 disposed on large diameter section 9B as is seen in FIG. 7 can allow polishing of the outer periphery of large diameter section 9B of core tube 9 without the need for preparing special jigs and the like for sustaining core tube 9. Thus, centerless polishing known as easy machining can be adopted, to thereby allow efficient finishing and the like.

Figure 8:
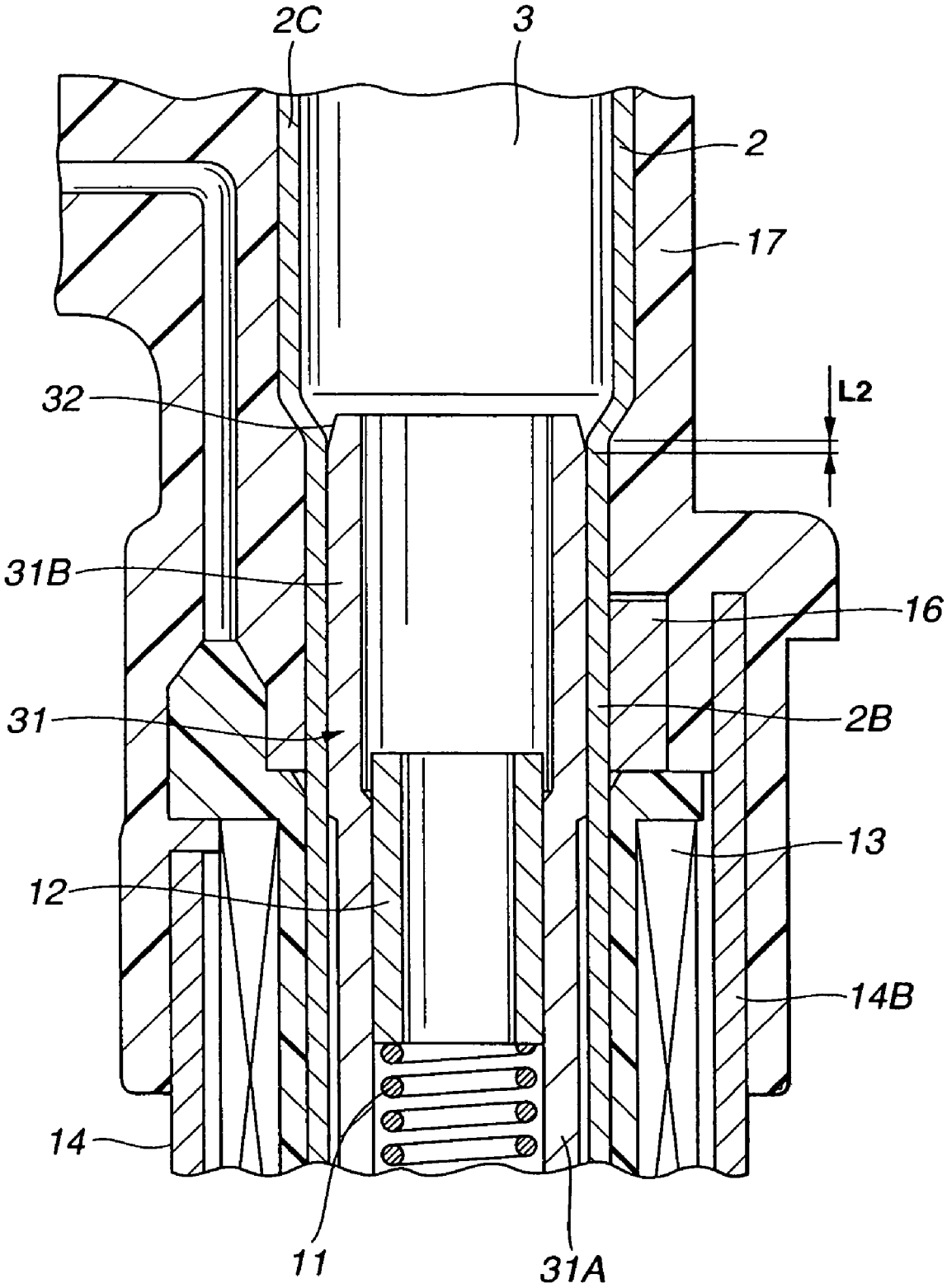
FIG. 8 shows a view similar to FIG. 5, but showing a core tube 31 and the like of the fuel injection valve, according to a second embodiment of the present invention.

As is seen in FIG. 8, there is provided a fuel injection valve applied to the automotive engine, according to a second embodiment of the present invention.

In the second embodiment, parts and sections substantially the same as those according to the first embodiment are denoted by the same numerals, and repeated descriptions are omitted. The feature of the second embodiment is a chamfer section 32 as a reduced diameter section around an outer periphery on a second end side (upper in FIG. 8) of a core tube 31.

Like core tube 9 according to the first embodiment, there is provided core tube 31 which is constituted of a small diameter section 31A and a large diameter section 31B. Chamfer section 32 as the reduced diameter section can be formed by tapering an outer periphery on a second end side (upper in FIG. 8) of large diameter section 31B. Chamfer section 32 is so formed as to extend to a position defining a length L2 (L2>0) relative to the second end of core tube mating section 2B of tubular body 2.

In sum, according to the second embodiment operations and effects substantially the same as those according to the first embodiment can be caused. Especially, according to the second embodiment, chamfer section 32 can be formed with ease by simply tapering the outer periphery on the second end side of core tube 31, thereby further facilitating machining operation.

Figure 9:
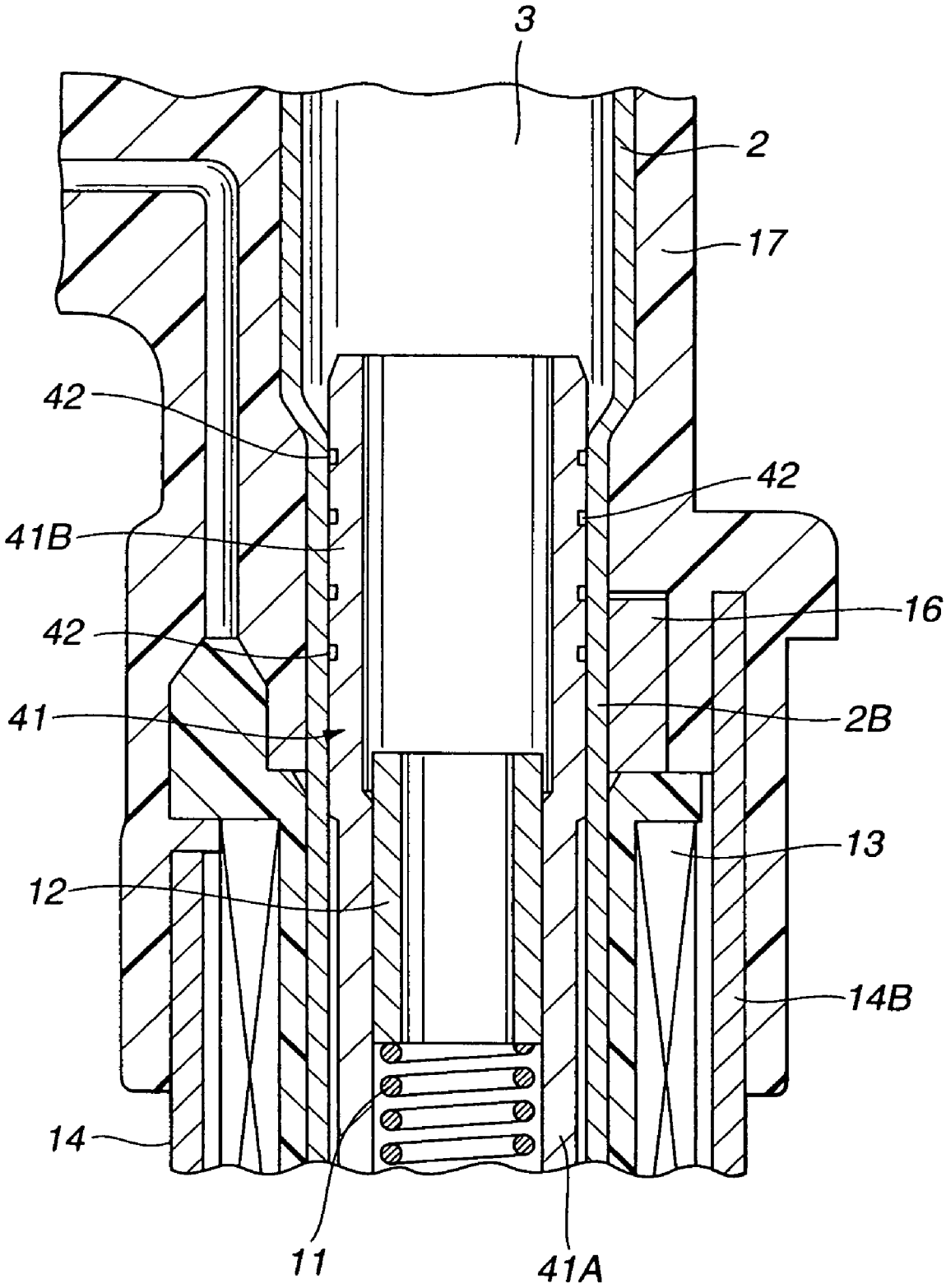
FIG. 9 shows a view similar to FIG. 5, but showing a core tube 41 and the like of the fuel injection valve, according to a third embodiment of the present invention.

As is seen in FIG. 9, there is provided a fuel injection valve applied to the automotive engine, according to a third embodiment of the present invention.

In the third embodiment, parts and sections substantially the same as those according to the first embodiment are denoted by the same numerals, and repeated descriptions are omitted. The feature of the third embodiment is an annular groove 42 as a reduced diameter section around an outer periphery on a second side (upper in FIG. 9) of a core tube 41.

Like core tube 9 according to the first embodiment, there is provided core tube 41 which is constituted of a small diameter section 41A and a large diameter section 41B. A plurality of annular grooves 42 as the reduced diameter section can be formed in such a manner as to be spaced apart axially from each other in positions for frictional abutment between an outer periphery (of large diameter section 41B) and core tube mating section 2B. In addition, each of annular grooves 42 has a cross section shaped substantially into a Japanese katakana character コ (rectangular character), for example, with groove width of about 100 μm and groove depth of about 100 μm.

In sum, according to the third embodiment operations and effects substantially the same as those according to the first embodiment can be caused. Especially, according to the third embodiment, the plurality of annular grooves 42 are formed on the outer periphery of large diameter section 41B, thereby effecting the anchor effect (wedge operation) and further improving accuracy in positioning core tube 41 in tubular body 2.

Although the present invention has been described above by reference to three embodiments, the present invention is not limited to the three embodiments described above. Modifications and variations of the embodiments described above will occur to those skilled in the art, in light of the above teachings.

More specifically, according to the third embodiment, annular groove 42 formed on the outer periphery of large diameter section 41B of core tube 41 is plural in number. The present invention is, however, not limited to this. For example, annular groove 42 can be singular in number. In addition, the cross section of annular groove 42 may not necessarily be shaped substantially into the Japanese katakana character コ (rectangular character). Instead, the cross section of annular groove 42 can be a semicircle, an alphabetical U, an alphabetical V, and the like.

The entire contents of basic Japanese Patent Application No. P2001-395543 (filed on Dec. 27, 2001 in Japan) of which priority is claimed is incorporated herein by reference, in order to take some protection against mis-translation or omitted portions.

The scope of the present invention is defined with reference to the following claims.

What is claimed is:

1. A method of forming a core tube of a fuel injection valve having an injector nozzle, comprising the following operations of:

1) preparing a magnetic metal material;

2) cutting the magnetic metal material substantially into a tube as a core tube having a small diameter section at a nozzle side and a large diameter section larger in diameter than the small diameter section, the large diameter section extending from the small diameter section and the large diameter section formed with a uniform outside diameter;

3) polishing an inner periphery and an outer periphery of the thus cut tube; and 4) forming a reduced diameter section around an entire circumference of the outer periphery of a portion of the large diameter section of the core tube at an end face of the core tube opposite to the nozzle side.

2. The method of forming the core tube of the fuel injection valve as claimed in claim 1, wherein the cutting step comprises forming the small diameter section such that it is adjacent to the large diameter section.

3. The method of forming the core tube of the fuel injection valve as claimed in claim 2, wherein the cutting step comprises forming the small diameter section substantially along its entire axial length with a first uniform outside diameter.

4. The method of forming the core tube of the fuel injection valve as claimed in claim 1, wherein the reduced diameter section is sized to provide a wedge action with the force oblique to an axial direction of the tube so that a return movement of said tube can be controlled.

5. The method of forming the core tube of the fuel injection valve as claimed in claim 1, wherein the cutting step comprises forming the large diameter section having an outside cylindrical surface, and the polishing step comprises polishing the outside cylindrical surface of the large diameter section with a degree of accuracy to press-fit the large diameter section into an inside cylindrical surface of a mating tubular member.

6. The method of forming the core tube of the fuel injection valve as claimed in claim 1, wherein the cutting step comprises forming the large diameter section and the small diameter section so that a gravity center of the core tube is located in the large diameter section.

7. A method of forming a core tube of a fuel injection valve, comprising the following operations of:

1) preparing a magnetic metal material;

2) cutting the magnetic metal material substantially into a tube as a core tube having a small diameter section and a large diameter section larger in diameter than the small diameter section;

3) polishing an inner periphery and an outer periphery of the thus cut tube; and 4) forming a reduced diameter section around an entire circumference of the outer periphery on one side of the large diameter section of the core tube, wherein the magnetic metal material is so cut that a gravity center of the core tube is disposed at the large diameter section.

8. The method of forming the core tube of the fuel injection valve as claimed in claim 7, wherein the outer periphery of the large diameter section of the core tube is finished through a centerless polishing.

9. A method of forming a fuel injection valve, comprising:

preparing a stepped tubular body of a magnetic material, including a larger body section extending from a second body end of the stepped tubular body toward a first body end, a smaller body section which is smaller in sectional size than the larger body section and which extends from the first body end of the stepped tubular body toward the second body end, and a step portion connecting the larger body section and the smaller body section;

forming a stepped core tube extending from a second tube end to a first tube end, and including a smaller tube section extending from the first tube end toward the second tube end of the stepped core tube, and a larger tube section extending from the second tube end to the smaller tube section of the stepped tubular body, the larger tube section of the stepped core tube including a reduced portion formed in a second end portion of the larger tube section;

fixing the stepped core tube in the stepped tubular body so that the smaller tube section is located between the larger tube section and the first body end of the stepped tubular body, by inserting the stepped core tube into the stepped tubular body from the second body end of the stepped tubular body and press-fitting the larger tube section in the smaller body section until the reduced portion is inserted beyond the step portion into the smaller body section of the stepped tubular body.

10. A method of forming a fuel injection valve, comprising:

preparing a stepped tubular body of a magnetic material, including a larger body section extending from a second body end of the stepped tubular body toward a first body end, a smaller body section which is smaller in sectional size than the larger body section and which extends from the first body end of the stepped tubular body toward the second body end, and a step portion connecting the larger body section and the smaller body section;

forming a stepped core tube extending from a second tube end to a first tube end, and including a smaller tube section extending from the first tube end toward the second tube end of the stepped core tube, and a larger tube section extending from the second tube end to the smaller tube section of the stepped tubular body, the larger tube section of the stepped core tube including a reduced portion formed in a second end portion of the larger tube section;

fixing the stepped core tube in the stepped tubular body so that the smaller tube section is located between the larger tube section and the first body end of the stepped tubular body, by inserting the stepped core tube into the stepped tubular body from the second body end of the stepped tubular body and press-fitting the larger tube section in the smaller body section until the reduced portion is inserted beyond the step portion into the smaller body section of the stepped tubular body.

* * * * *